United States Patent [19]

Nomura et al.

[11] Patent Number: 4,573,666

[45] Date of Patent: Mar. 4, 1986

[54] APPARATUS FOR QUENCHING BUTT-WELDED PORTION OF RAIL

[75] Inventors: Hirokazu Nomura; Yukihiko Sato, both of Tsu; Eiji Morishige, Hisai, all of Japan

[73] Assignee: Nippon Kokan Kabushiki Kaisha, Tokyo, Japan

[21] Appl. No.: 630,931

[22] Filed: Jul. 16, 1984

[30] Foreign Application Priority Data

Aug. 5, 1983 [JP] Japan ..... 58-142478

[51] Int. Cl.[4] ..... C21D 1/62

[52] U.S. Cl. ..... 266/80; 266/87; 266/259; 228/46

[58] Field of Search ..... 266/80, 87, 125, 124, 266/134, 259, 114, 287, 258; 148/128, 144, 145, 149; 228/46

[56] References Cited

U.S. PATENT DOCUMENTS

| | | | |
|---|---|---|---|
| 1,704,410 | 3/1929 | Stedefeld | 148/146 |
| 2,480,573 | 8/1949 | Hall | 266/260 |
| 2,538,366 | 1/1951 | Kerwin | 148/146 |
| 3,110,277 | 11/1963 | Dixon et al. | 228/46 |
| 3,275,481 | 9/1966 | Adams, Jr. | 148/146 |
| 3,456,333 | 7/1969 | Meier et al. | 148/146 |
| 4,243,441 | 1/1981 | Wilson | 148/128 |
| 4,440,584 | 3/1984 | Takeshige et al. | 148/128 |
| 4,486,248 | 12/1984 | Ackert et al. | 148/145 |

FOREIGN PATENT DOCUMENTS

| | | | |
|---|---|---|---|
| 609575 | 11/1960 | Canada | 266/134 |

*Primary Examiner*—Christopher W. Brody

*Attorney, Agent, or Firm*—Frishauf, Holtz, Goodman & Woodward

[57] ABSTRACT

An apparatus for quenching a butt-welded portion of a rail, includes an inverse U-shaped cooling box for covering from above and throughout a butt-welded portion of a rail, and for quenching the butt-welded portion by cooling air. The cooling box is divided into a head cooling chamber, a web left cooling chamber, and a web right cooling chamber each having a plurality of cooling air nozzles directed toward the butt-welded portion. A cooling air supply mechanism supplies cooling air to the cooling box, the cooling air supply mechanism including a cooling air source, a solenoid valve operatively arranged in a cooling air supply pipe, a head cooling air regulating valve, a web cooling air regulating valve, and a valve opening controlling mechanism which opens each of the head cooling air regulating valve and the web cooling air regulating valve according to a predetermined program. A cooling box holding mechanism releasably holds the cooling box at a prescribed position so as to cover the rail throughout the butt-welded portion.

8 Claims, 16 Drawing Figures

APPARATUS FOR QUENCHING BUTT-WELDED PORTION OF RAIL

FIELD OF THE INVENTION

The present invention relates to an apparatus for quenching a butt-welded portion of a rail, so as to prevent a decrease in hardness of the rail head in the butt-welded portion from occurring when butt-welding two rails each having the rail head hardened by a heat treatment.

BACKGROUND OF THE INVENTION

A rail head is always subjected to contact friction with wheels of trains and to heavy load. In order to harden the rail head to prevent wear thereof, therefore, a heat treatment is applied to impart a high wear resistance to the rail head.

With a view to reducing the number of joints of rails, it is now the usual practice to butt-weld a plurality of rails having a prescribed length by a flash welding process, for example, to prepare a long rail. However, in a long rail thus prepared by butt-welding the plurality of rails, hardness of the rail head decreases in the butt-welded portion under the effect of welding heat. FIG. 1 is a graph illustrating Brinell hardness of the rail head top in the butt-welded portion of a rail. As is clear from FIG. 1, there is observed a remarkable decrease in Brinell hardness of the rail head top, in a welding heat affected zone within a distance of about 20 mm from the butt-welded face as compared with the other portions of the rail head top not affected by welding heat. When trains pass on such rails, the rail head top in the butt-welded portion wears, is deformed, and is caved in earlier than the other portions along with the increase of train passages. As a result, noise is produced when a train passes on these rails and the train is subjected to vibrations.

Under such circumstances, there is a strong demand for development of an apparatus for preventing, when butt-welding a plurality of rails having a prescribed size, a decrease in hardness from occurring on the rail head in the butt-welded portion affected by welding heat, but no such apparatus has been proposed as far as is known.

SUMMARY OF THE INVENTION

An object of the present invention is therefore to provide an apparatus for quenching a butt-welded portion of a rail so as to prevent a decrease in hardness of the rail head in the butt-welded portion affected by welding heat from occurring, when butt-welding a plurality of rails each having a prescribed size and the rail head hardened by a heat treatment.

In accordance with one of the features of the present invention, there is provided an apparatus for quenching a butt-welded portion of a rail, comprising:

an inverse U-shaped cooling box (2) for covering from above and throughout a butt-welded portion of a rail (1), and for quenching said butt-welded portion by ejection of cooling air, said cooling box (2) including two partition plates (9, 10) for dividing the cooling box into a head cooling chamber (3), a web left cooling chamber (7) and a web right cooling chamber (8), which chambers are independent of each other, each of said head cooling chamber, said web left cooling chamber and said web right cooling chamber having a plurality of cooling air nozzles (13) adapted to be directed toward said butt-welded portion;

a cooling air supply mechanism for supplying cooling air to said cooling box (2), said cooling air supply mechanism comprising a cooling air source (20), a solenoid valve (22) for opening or closing the flow of cooling air, a cooling air supply pipe arranged with the solenoid valve for introducing cooling air from said cooling air source (20) into each of said head cooling chamber (3), said web left cooling chamber (7) and said web right cooling chamber (8), a head cooling air regulating valve (16) for regulating a flow rate of cooling air to be supplied to said head cooling chamber (3), a web cooling air regulating valve (17) for regulating a flow rate of cooling air to be supplied to said web left cooling chamber (7) and said web right cooling chamber (8), and a valve opening controlling means for controlling, in accordance with a predetermined program, an opening of each of said head cooling air regulating valve (16) and said web cooling air regulating valve (17); and a cooling box holding mechanism (36) for releasably holding said cooling box (2) at a prescribed position so as to cover said rail (1) throughout the butt-welded portion.

DETAILED DESCRIPTION OF PREFERRED EMBODIMENTS

From the above-mentioned point of view, extensive studies were carried out with a view to developing an apparatus for quenching a butt-welded portion of a rail, for preventing decrease in hardness of the rail head in the butt-welded portion affected by welding heat from occurring, when butt-welding a plurality of rails each having a prescribed size with the rail head hardened by a heat treatment. As a result, it has been discovered that the problem described above can be solved by using a quenching apparatus which comprises an inverse U-shaped cooling box for covering from above throughout a butt-welded portion of a rail and for quenching the butt-welded portion by means of cooling air, a cooling air supply mechanism for controllably supplying cooling air to the cooling box in accordance with a previously set program, and a cooling box holding mechanism for releasably holding the cooling box at a prescribed position so as to cover throughout the butt-welded portion of the rail, and means for quenching the butt-welded portion of the rail immediately after butt-welding.

The present invention was conceived on the basis of the above-mentioned finding, and an embodiment of the present apparatus for quenching a butt-welded portion of a rail is described below with reference to FIGS. 2 to 8.

Figure 4:
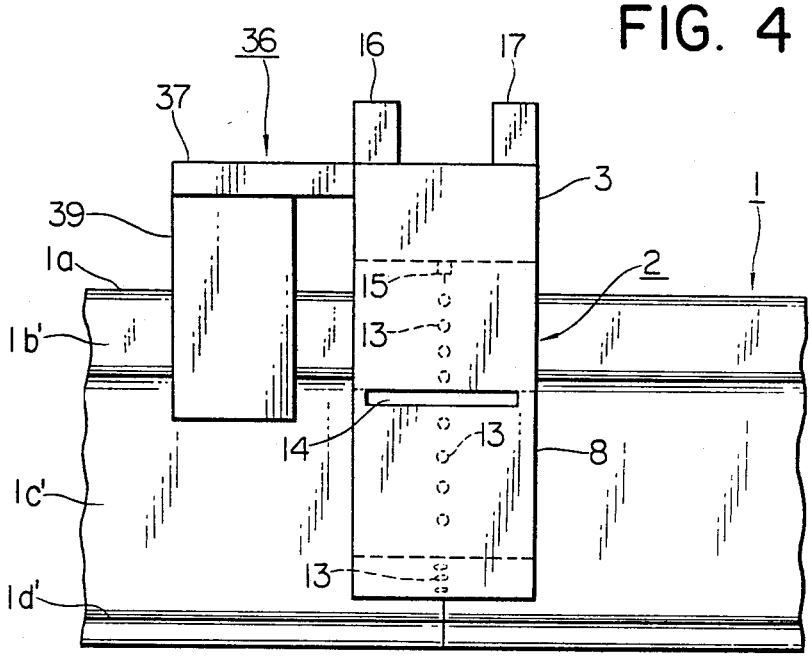
FIG. 4 is a schematic side view illustrating the apparatus of the present invention shown in FIG. 2.
Figure 5:
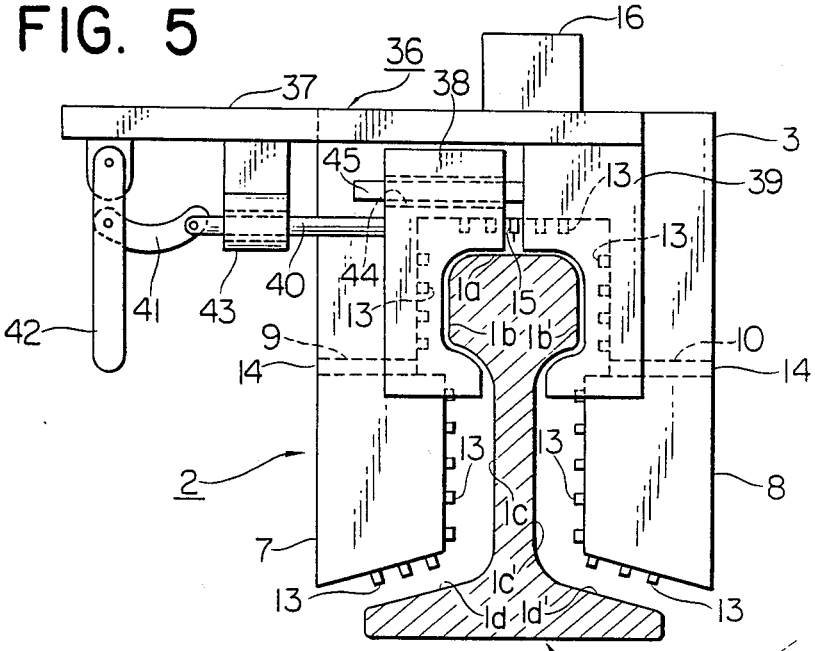
FIG. 5 is a schematic front view illustrating the apparatus of the present invention shown in FIG. 2.
Figure 9:
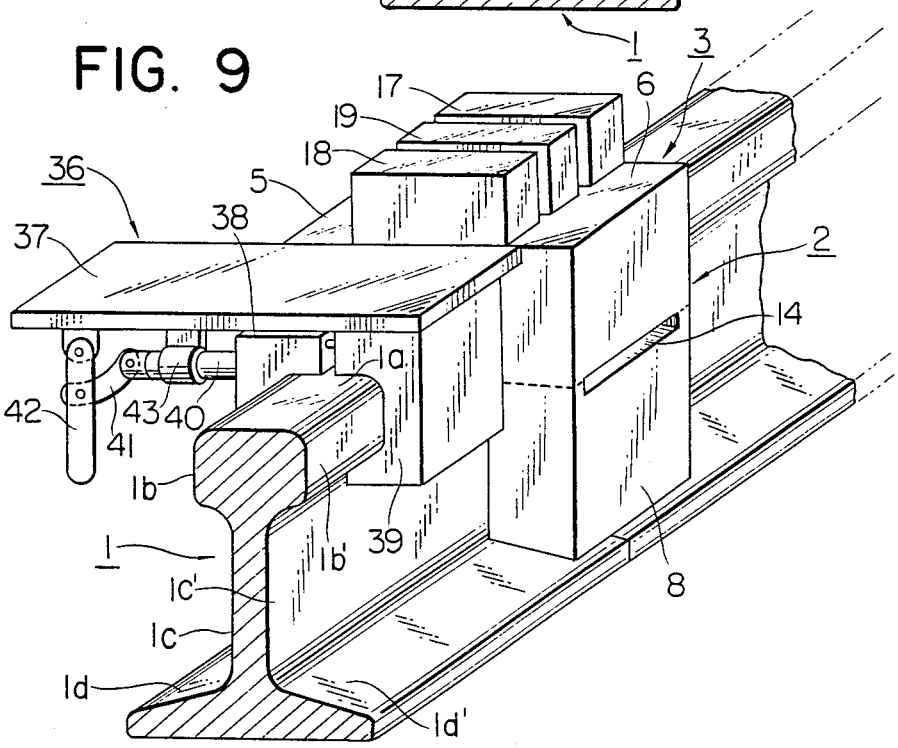
FIG. 9 is a schematic perspective view illustrating another embodiment of the apparatus of the present invention.
Figure 6:
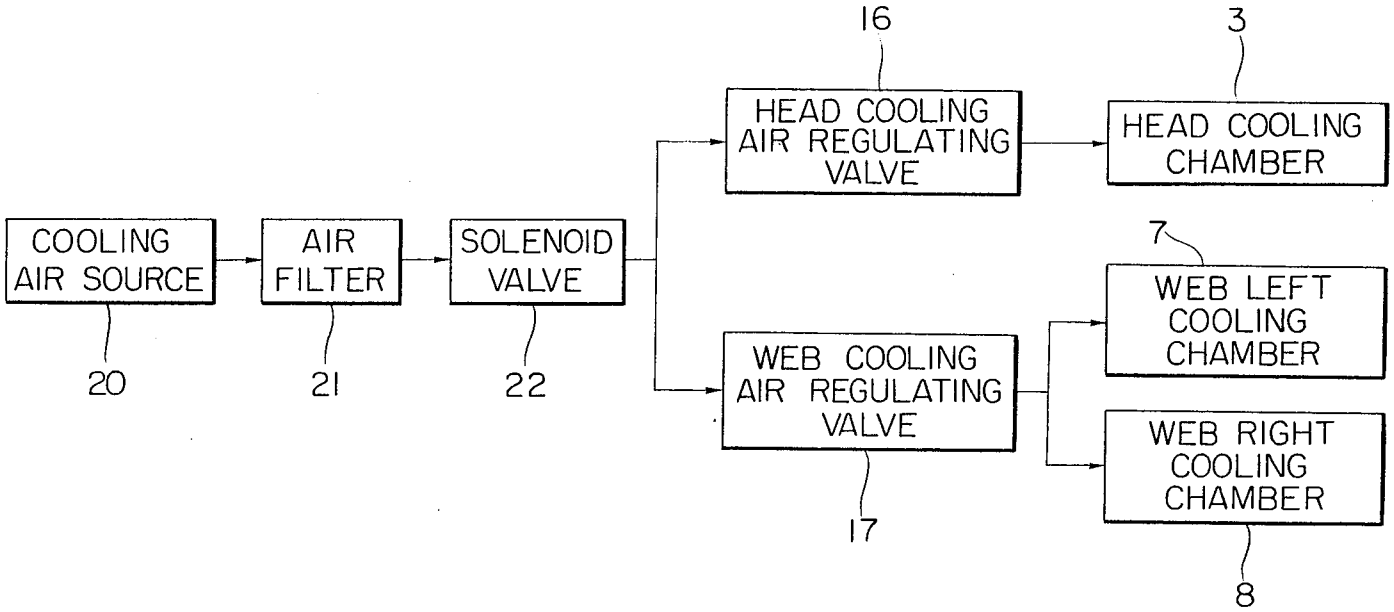
FIG. 6 is a block diagram illustrating an outline of the cooling air supply mechanism which is one of the components of the apparatus of the present invention shown in FIG. 2.
Figure 7:
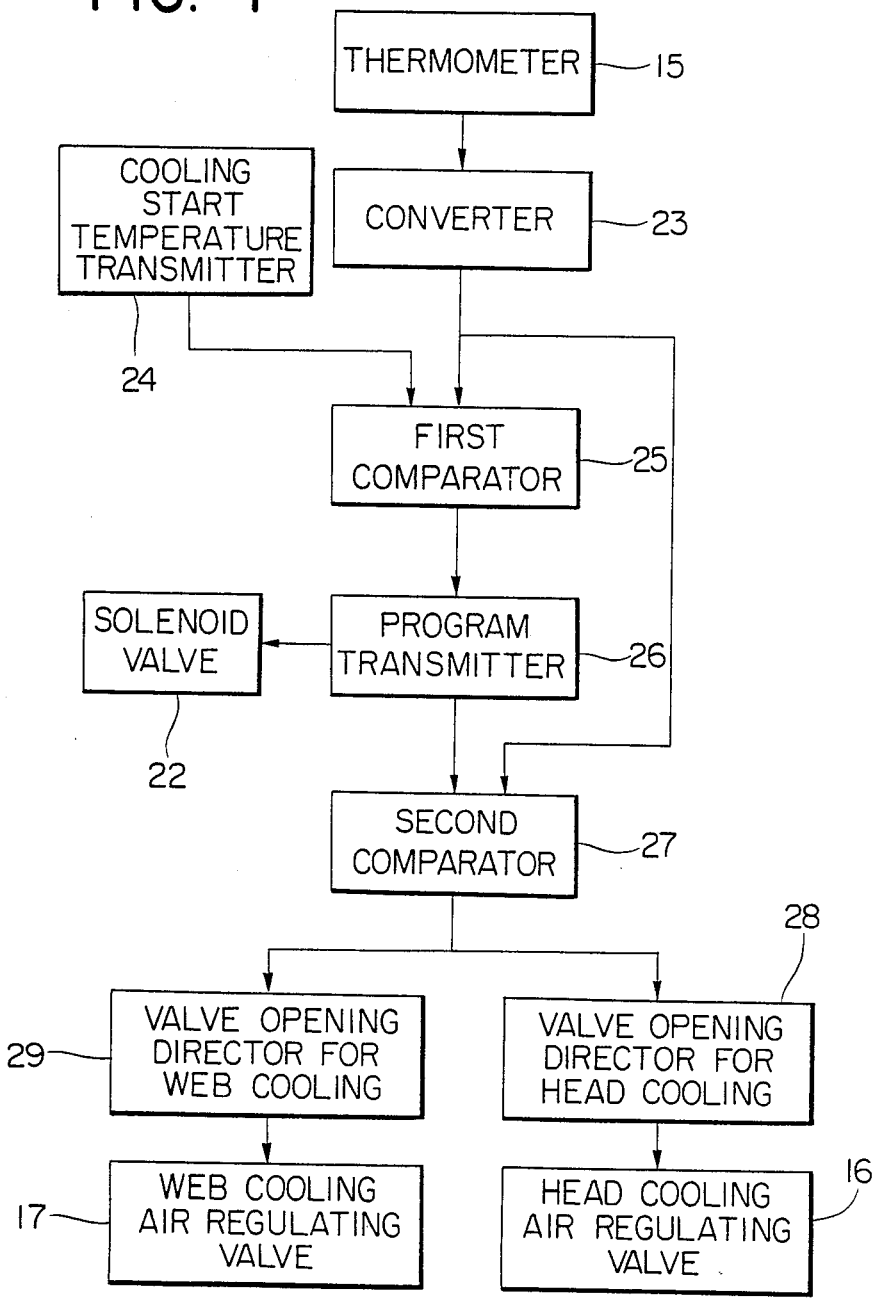
FIG. 7 is a block diagram illustrating a first embodiment of the valve opening controlling means of the cooling air supply mechanism, which valve opening controlling means is one of the components of the apparatus of the present invention shown in FIG. 2.
Figure 8:
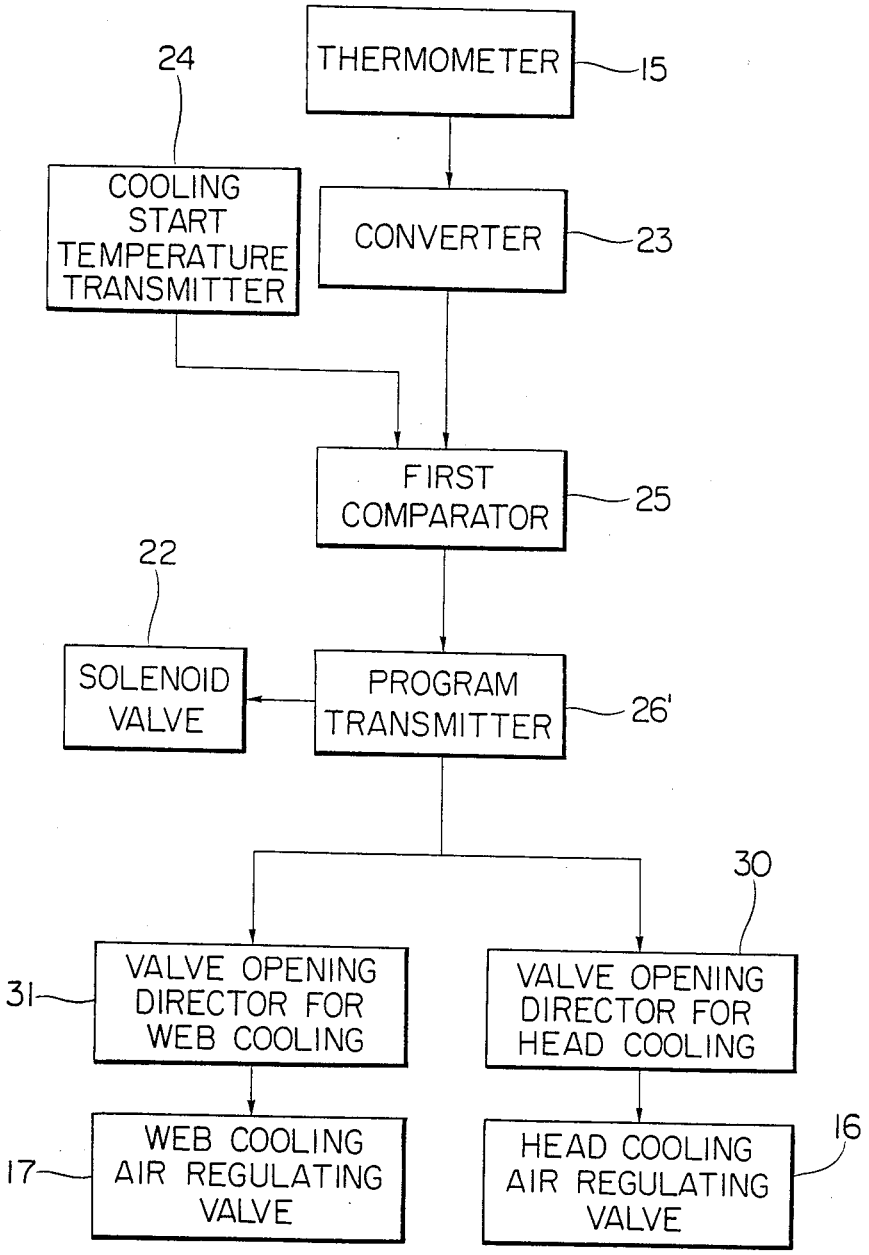
FIG. 8 is a block diagram illustrating a second embodiment of the valve opening controlling means of the cooling air supply mechanism, which valve opening controlling means is one of the components of the apparatus of the present invention shown in FIG. 2.
Figure 10:
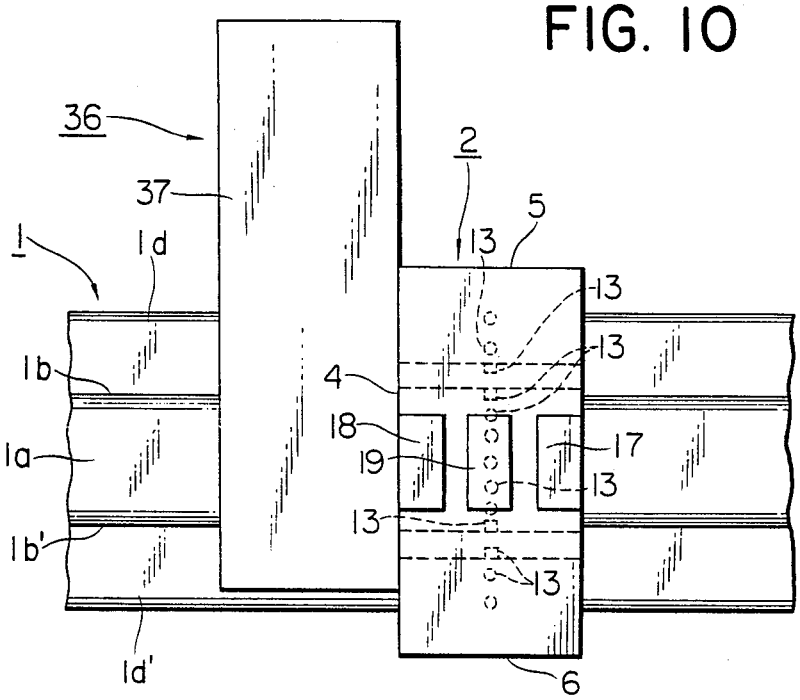
FIG. 10 is a schematic plan view illustrating the apparatus of said another embodiment of the present invention shown in FIG. 9.

The quenching apparatus of the present invention comprises an inverse U-shaped cooling box 2 for quenching a butt-welded portion of a rail 1 by ejection of cooling air, a cooling box holding mechanism 36 for releasably holding the cooling box 2 at a prescribed position so as to cover throughout the butt-welded portion of the rail 1, as shown in FIGS. 2 to 5, and a cooling air supply mechanism for supplying cooling air to the cooling box 2, as shown in FIGS. 6 to 8.

As shown in FIGS. 2 to 5, the cooling box 2 is divided by two partition plates 9 and 10 into a head cooling chamber 3, a web left cooling chamber 7 and a web right cooling chamber 8, which are independent of each other. The head cooling chamber 3 has a plurality of cooling air nozzles 13 directed toward a rail head top 1*a* and rail head sides 1*b* and 1*b'* of the butt-welded portion of the rail 1. The web left cooling chamber 7 has a plurality of cooling air nozzles 13 directed toward a rail web side 1*c* and a rail bottom surface 1*d* of the butt-welded portion of the rail 1. The web right cooling chamber 8 has a plurality of cooling air nozzles 13 directed toward the other rail web side 1*c'* and the other rail bottom surface 1*d'* of the butt-welded portion of the rail 1. The upper portion of each of the web left cooling chamber 7 and the web right cooling chamber 8 is provided with a slit 14 for discharging, to the outside, cooling air ejected through the plurality of cooling air nozzles 13 onto the butt-welded portion of the rail 1.

As shown in FIG. 6, the cooling air supply mechanism for supplying cooling air to the cooling box 2 comprises a cooling air source 20 (for example, a compressor for compressing air to a high pressure), a solenoid valve 22 for opening or closing the flow of cooling air, provided in the middle of a cooling air supply pipe (not shown) for introducing cooling air from the cooling air source 20 into each of the head cooling chamber 3, the web left cooling chamber 7 and the web right cooling chamber 8, a head cooling air regulating valve 16 for regulating the flow rate of cooling air to be supplied to the head cooling chamber 3, a web cooling air regulating valve 17 for regulating the flow rate of cooling air to be supplied to the web left cooling chamber 7 and the web right cooling chamber 8, and a valve opening controlling means for controlling, in accordance with a previously set program, the opening of each of the head cooling air regulating valve 16 and the web cooling air regulating valve 17. In FIG. 6, an air filter 21 is provided in the middle of the cooling air supply pipe, for removing dust contained in cooling air. The head cooling air regulating valve 16 and the web cooling air regulating valve 17, which are provided on the upper surface of the cooling box 2 in FIGS. 2 to 5, may be provided at any place on the cooling box 2 such as on the sides thereof, not limiting to the upper surface thereof.

FIG. 7 is a block diagram illustrating a first embodiment of the valve opening controlling means of the cooling air supply mechanism. As shown in FIG. 7, the valve opening controlling means of the first embodiment comprises a thermometer 15, a converter 23, a cooling start temperature transmitter 24, a first comparator 25, a program transmitter 26, a second comparator 27, a valve opening director for head cooling 28, and a valve opening director for web cooling 29.

The thermometer 15 is, as shown in FIGS. 4 and 5, provided in the head cooling chamber 3 of the cooling box 2, toward the rail head top 1*a* of the butt-welded portion of the rail 1, and continuously measures the surface temperature of the rail head top 1*a* of the butt-welded portion. The converter 23 converts the surface temperature of the rail head top 1*a* of the butt-welded portion, continuously measured by the thermometer 15, into an electric signal, and transmits the thus converted electric signal corresponding to the measured surface temperature of the rail head top 1*a* of the butt-welded portion, parallelly toward the first comparator 25 and the second comparator 27.

The cooling start temperature transmitter 24 transmits a previously set cooling start temperature for the rail head top 1*a* of the butt-welded portion toward the first comparator 25 in the form of an electric signal. The first comparator 25 transmits a cooling start electric signal toward the program transmitter 26 at the moment when the electric signal from the converter 23, which corresponds to the measured surface temperature of the rail head top 1*a* of the butt-welded portion, agrees with the electric signal from the cooling start temperature transmitter 24, which corresponds to the previously set cooling start temperature. The program transmitter 26 transmits an electric signal for opening the solenoid valve 22 in response to the cooling start electric signal from the first comparator 25 toward the solenoid valve 22, and, at the same time, transmits a previously set time-serial target surface temperature for the rail head top 1*a* of the butt-welded portion, during the cooling period from cooling start up to cooling completion, in the form of an electric signal, toward the second comparator 27. In addition, the program transmitter 26 transmits, upon completion of the previously set cooling period, an electric signal for closing the solenoid valve 22 to the solenoid valve 22.

The second comparator 27 continuously calculates a difference value between (a) the electric signal from the converter 23, which corresponds to the measured surface temperature of the rail head top 1*a* of the butt-welded portion, and (b) the electric signal from the program transmitter 26, which corresponds to the time-serial target surface temperature, and transmits the thus calculated difference value to the valve opening director for head cooling 28 and the valve opening director for web cooling 29.

The valve opening director for head cooling 28 amplifies the above-mentioned difference value calculated by the second comparator 27, and transmits, to the head cooling air regulating valve 16, an opening of the head cooling air regulating valve 16 in the form of an electric signal, in which the above-mentioned amplified difference value becomes null. The valve opening director for web cooling 29 amplifies the above-mentioned difference value calculated by the second comparator 27, and transmits, to the web cooling air regulating valve 17, an opening of the web cooling air regulating valve 17 in the form of an electric signal, in which the above-mentioned amplified difference value becomes null.

FIG. 8 is a block diagram illustrating a second embodiment of the valve opening controlling means of the cooling air supply mechanism. As shown in FIG. 8, the valve opening controlling means of the cooling air supply mechanism in the second embodiment comprises a thermometer 15, a converter 23, a cooling start temperature transmitter 24, a first comparator 25, a program transmitter 26', a valve opening director for head cooling 30 and a valve opening director for web cooling 31.

The individual functions of the thermometer 15, the converter 23, the cooling start temperature transmitter 24 and the first comparator 25 are as described for the first embodiment of the valve opening controlling means of the cooling air supply mechanism. However, the converter 23 transmits an electric signal corresponding to the measured surface temperature of the rail head top 1*a* of the butt-welded portion, only to the first comparator 25. The program transmitter 26' transmits an electric signal for opening the solenoid valve 22 in response to the cooling start electric signal from the first comparator 25 to the solenoid valve 22, and, at the same time, transmits a previously set time-serial target flow rate of cooling air, during the cooling period from cooling start up to cooling completion, in the form of an electric signal to the valve opening director for head cooling 30 and the valve opening director for web cooling 31. In addition, the program transmitter 26' transmits, upon completion of the previously set cooling period, an electric signal for closing the solenoid valve 22 to the solenoid valve 22.

The valve opening director for head cooling 30 amplifies the above-mentioned electric signal from the program transmitter 26', which corresponds to the time-serial target flow rate of cooling air, and transmits, to the head cooling air regulating valve 16, an opening of the head cooling air regulating valve 16 in the form of an electric signal in response to the above-mentioned amplified electric signal. The valve opening director for web cooling 31 amplifies the above-mentioned electric signal from the program transmitter 26' corresponding to the time-serial target flow rate of cooling air, and transmits, to the web cooling air regulating valve 17, an opening of the web cooling air regulating valve 17 in the form of an electric signal in response to the above-mentioned amplified electric signal.

Figure 1:
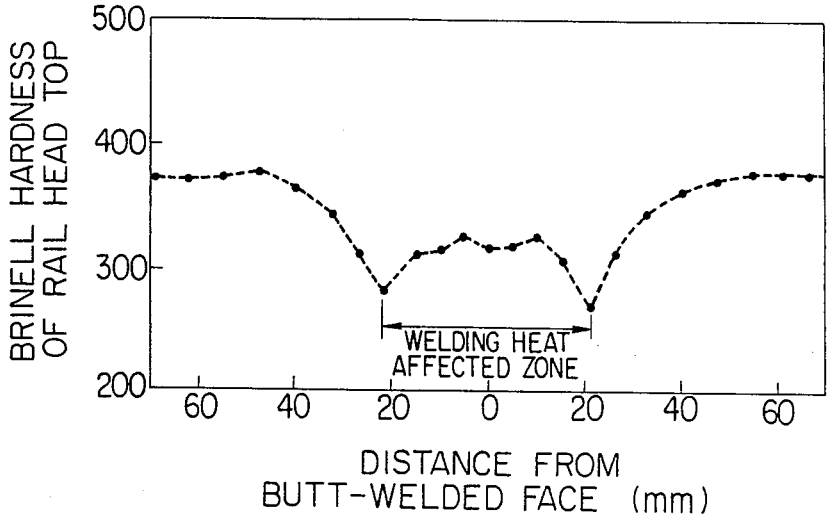
FIG. 1 is a graph illustrating Brinell hardness of the rail head top in the butt-welded portion of a rail.
Figure 2:
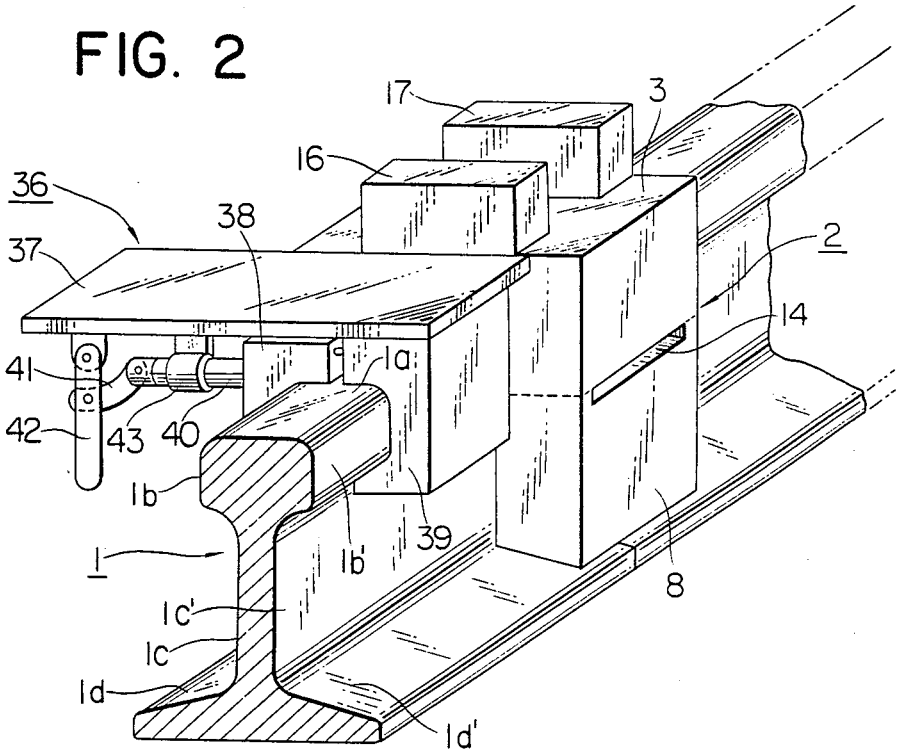
FIG. 2 is a schematic perspective view illustrating an embodiment of the apparatus of the present invention.
Figure 3:
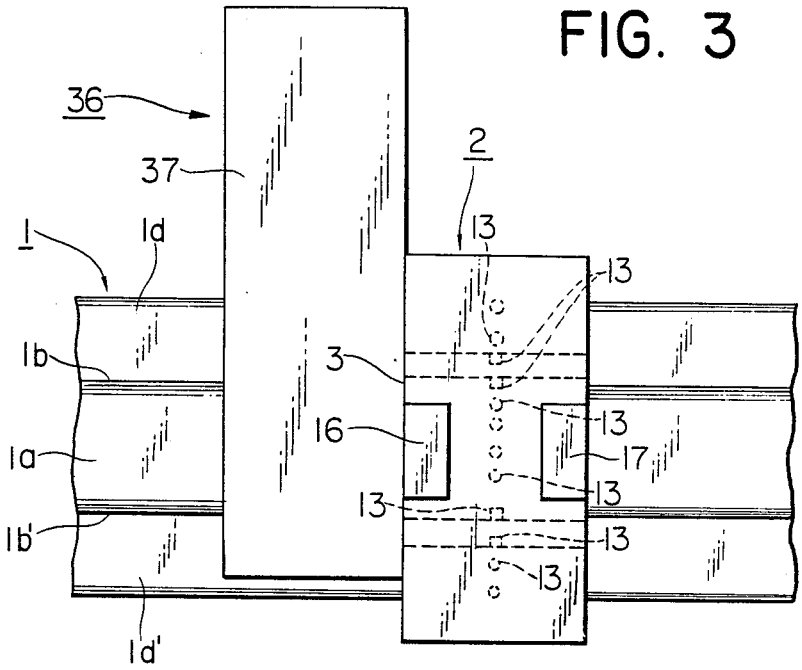
FIG. 3 is a schematic plan view illustrating the apparatus of the present invention shown in FIG. 2.

As shown in FIGS. 2 and 5, the cooling box holding mechanism 36 comprises a horizontal supporting plate 37, a pair of clamps 38 and 39 provided on the lower surface of the supporting plate 37, for gripping the head of the rail 1 to releasably hold the cooling box 2 at a prescribed position so as to cover throughout the butt-welded portion of the rail 1, a horizontal rod 40, and a lever 42. The supporting plate 37 is fixed to a side extending at right angles to the axial line of the rail 1, of the cooling box 2. One clamp 38 of the pair of clamps 38 and 39 is slidable at right angles to the axial direction of the rail 1 along the lower surface of the supporting plate 37, and the other clamp 39 of the pair of clamps 38 and 39 is fixed to the lower surface of the supporting plate 37.

The rod 40 is horizontally fixed, at one end thereof, to the slidable clamp 38, and projects at right angles to the axial direction of the rail 1. The rod 40 is horizontally movably supported by a tubular support fitting 43 fixed to the lower surface of the supporting plate 37. The lever 42 is connected via a link 41 to the other end of the rod 40. The top end of the lever 42 is connected via a pin to the lower surface of the supporting plate 37. At least one guiding rod 45 is horizontally fixed, at one end thereof, to the other clamp 39 fixed to the lower surface of the supporting plate 37, and projects at right angles to the axial direction of the rail 1. The slidable clamp 38 is provided with at least one through-hole 44 for receiving the guiding rod 45.

Thus, by operating the lever 42, the slidable clamp 38 moves forward via the rod 40 and the link 41 along the guiding rod 45 received in the through-hole 44 in the clamp 38, and grips the head of the rail 1 in cooperation with the other clamp 39, thereby holding the cooling box 2 at a prescribed position so as to cover throughout the butt-welded portion of the rail 1.

By the application of the quenching apparatus of the present invention having the structure as described above, the butt-welded portion of the rail 1 is quenched as follows:

Immediately after the completion of the butt-welding of the rail 1, the present quenching apparatus is installed at a prescribed position of the rail 1 by operating the lever 42 of the cooling box holding mechanism 36, so that the cooling box 2 covers from above the rail 1 throughout the butt-welded portion. The thermometer 15 provided in the head cooling chamber 3 of the cooling box 2 continuously measures the surface temperature of the rail head top 1*a* of the butt-welded portion of the rail 1, and the converter 23 converts the thus continuously measured surface temperature of the rail head top 1*a* into an electric signal. The first comparator 25 transmits a cooling start electric signal toward the program transmitter 26 or 26' at the moment when the electric signal from the converter 23, which corresponds to the measured surface temperature of the rail top 1*a* of the butt-welded portion, agrees with the electric signal from the cooling start temperature transmitter 24 which corresponds to a previously set cooling start temperature.

The program transmitter 26 or 26' transmits an electric signal for opening the solenoid valve 22, in response to the cooling start electric signal from the first comparator 25, toward the solenoid valve 22. As a result of opening of the solenoid valve 22 caused by the electric signal from the program transmitter 26 or 26', cooling air is supplied from the cooling air source 20 through the head cooling air regulating valve 16 to the head cooling chamber 3, and through the web cooling air regulating valve 17 to each of the web left cooling chamber 7 and the web right cooling chamber 8.

Cooling air supplied to the head cooling chamber 3 is ejected through the plurality of cooling air nozzles 13 provided in the head cooling chamber 3 onto the rail head top 1*a* and the rail head sides 1*b* and 1*b'* of the butt-welded portion to quench the rail head top 1*a* and the rail head sides 1*b* and 1*b'*. Cooling air supplied to the web left cooling chamber 7 and the web right cooling chamber 8 is ejected through the plurality of cooling nozzles 13 provided in each of the web left cooling chamber 7 and the web right cooling chamber 8 onto the rail web sides 1*c* and 1*c'* and the rail bottom surfaces 1*d* and 1*d'* of the butt-welded portion, to quench the rail web sides 1*c* and 1*c'* and the rail bottom surfaces 1*d* and 1*d'*.

In the case of the first embodiment of the valve opening controlling means of the cooling air supply mechanism shown in FIG. 7, each opening of the head cooling air regulating valve 16 and the web cooling air regulating valve 17 is controlled as follows. The program transmitter 26 transmits, to the second comparator 27, the previously set time-serial target surface temperature for the rail head top 1*a* of the butt-welded portion in the form of an electric signal, during the cooling period from cooling start up to cooling completion in response to the cooling start electric signal from the first comparator 25. The second comparator 27 continuously calculates the difference between the electric signal from the converter 23 which corresponds to the measured surface temperature of the rail head top 1*a* of the butt-welded portion, and the electric signal from the program transmitter 26 which corresponds to the above-mentioned time-serial target surface temperature, and transmits the thus calculated difference value to the valve opening director for head cooling 28 and the valve opening director for web cooling 29.

The valve opening director for head cooling 28 amplifies the above-mentioned difference valve calculated by the second comparator 27, and transmits to the head cooling air regulating valve 16 an opening of the head cooling air regulating valve 16 in the form of an electric signal, in which the above-mentioned amplified difference value becomes null. The opening of the head cooling air regulating valve 16 is thus adjusted in response to the above-mentioned electric signal from the valve opening director for head cooling 28. The valve opening director for web cooling 29 amplifies the above-mentioned difference value calculated by the second comparator 27, and transmits to the web cooling air regulating valve 17 an opening of the web cooling air regulating valve 17 in the form of an electric signal, in which the above-mentioned amplified difference value becomes null. The opening of the web cooling air regulating valve 17 is thus adjusted in response to the above-mentioned electric signal from the valve opening director for web cooling 29.

In the case of the second embodiment of the valve opening controlling means of the cooling air supply mechanism shown in FIG. 8, each opening of the head cooling air regulating valve 16 and the web cooling air regulating valve 17 is controlled as follows. The program transmitter 26' transmits to the valve opening director for head cooling 30 and the valve opening director for web cooling 31, the previously set time-serial target flow rate of cooling air in the form of an electric signal during the cooling period from cooling start up to cooling completion, in response to the cooling start electric signal from the first comparator 25.

The valve opening director for head cooling 30 amplifies the electric signal from the program transmitter 26', which corresponds to the above-mentioned time-serial target flow rate of cooling air, and transmits to the head cooling air regulating valve 16 an opening of the head cooling air regulating valve 16 in the form of an electric signal, in response to the thus amplified electric signal. The opening of the head cooling air regulating valve 16 is thus adjusted in response to the above-mentioned electric signal from the valve opening director for head cooling 30. The valve opening director for web cooling 31 amplifies the electric signal from the program transmitter 26', which corresponds to the above-mentioned time-serial target flow rate of cooling air, and transmits to the web cooling air regulating valve 17 an opening of the web cooling air regulating valve 17 in the form of an electric signal, in response to the thus amplified electric signal. The opening of the web cooling air regulating valve 17 is thus adjusted in response to the above-mentioned electric signal from the valve opening director for web cooling 31.

Thus, the rail head top 1*a*, the rail head sides 1*b* and 1*b'*, the rail web sides 1*c* and 1*c'* and the rail bottom surfaces 1*d* and 1*d'* of the welded portion are quenched to a prescribed temperature by means of cooling air ejected from the plurality of cooling air nozzles 13 provided in each of the head cooling chamber 3, the web left cooling chamber 7 and the web right cooling chamber 8. Cooling air which has been ejected from the plurality of cooling air nozzles 13 and has quenched the butt-welded portion, is discharged to the outside through a gap between the cooling box 2 and the rail 1 and through the slit 14 provided in each of the web left cooling chamber 7 and the web right cooling chamber 8.

The program transmitter 26 or 26' transmits an electric signal for closing the solenoid valve 22, upon completion of the previously set cooling period, to the solenoid valve 22. The solenoid valve 22 is closed in response to the above-mentioned electric signal from the program transmitter 26 or 26', and thus, the supply of cooling air from the cooling air source 20 to each of the head cooling chamber 3, the web left cooling chamber 7, and the web right cooling chamber 8 is discontinued. After the completion of quenching of the butt-welded portion, the quenching apparatus of the present invention is removed from the rail 1 by operating the lever 42 of the cooling box holding mechanism 36.

Now, another embodiment of the present apparatus for quenching a butt-welded portion of a rail is described with reference to FIGS. 9 to 15.

In the apparatus of the embodiment shown in FIGS. 9 to 12, the head cooling chamber 3 of the cooling box 2 mentioned above with reference FIGS. 2 to 5, is further divided by two vertical partition plates 11 and 12 into a head top cooling chamber 4, a head side left cooling chamber 5 and a head side right cooling chamber 6, which are independent of each other.

Figure 11:
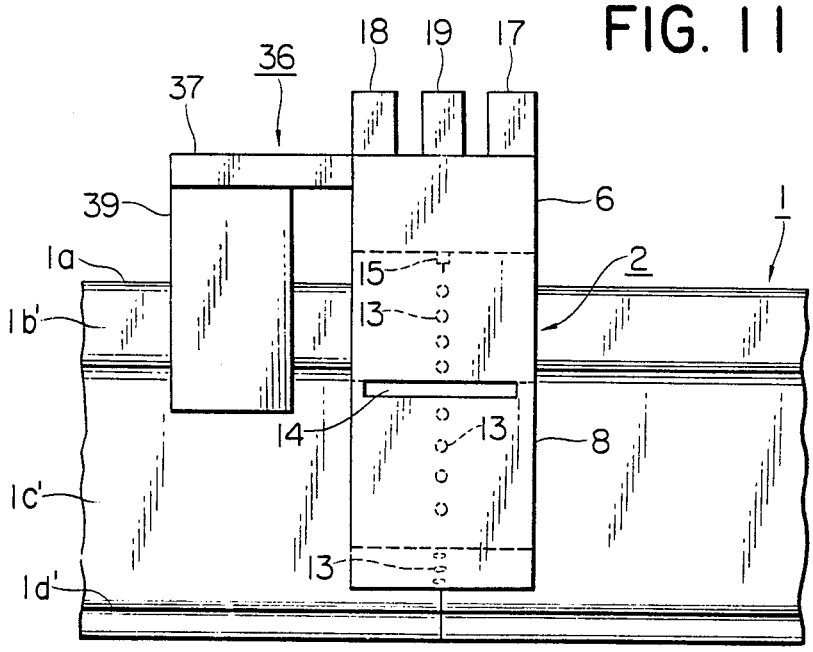
FIG. 11 is a schematic side view illustrating the apparatus of said another embodiment of the present invention shown in FIG. 9.
Figure 12:
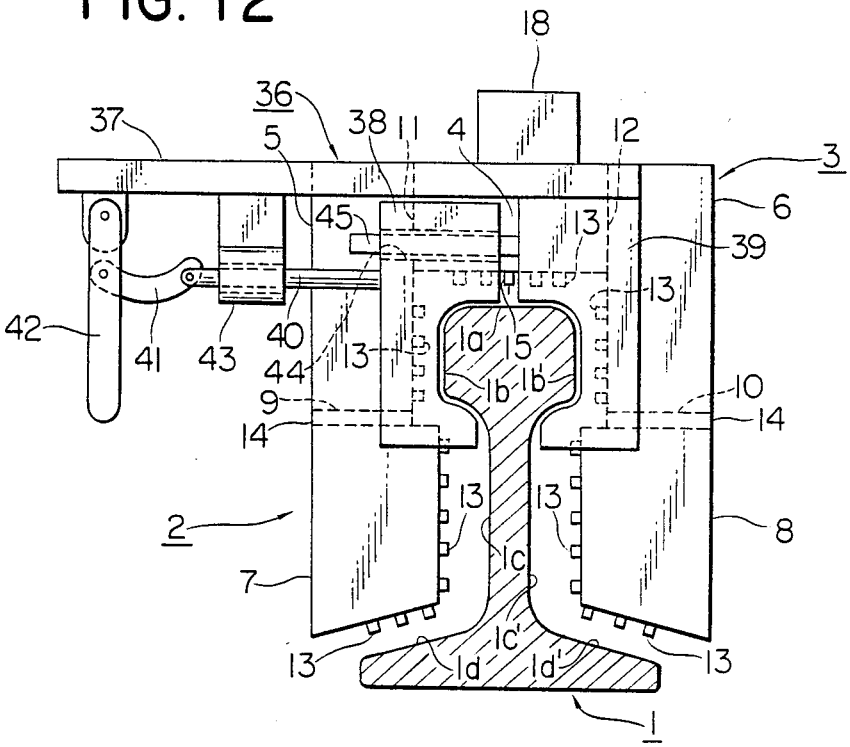
FIG. 12 is a schematic front view illustrating the apparatus of said another embodiment of the present invention shown in FIG. 9.
Figure 13:
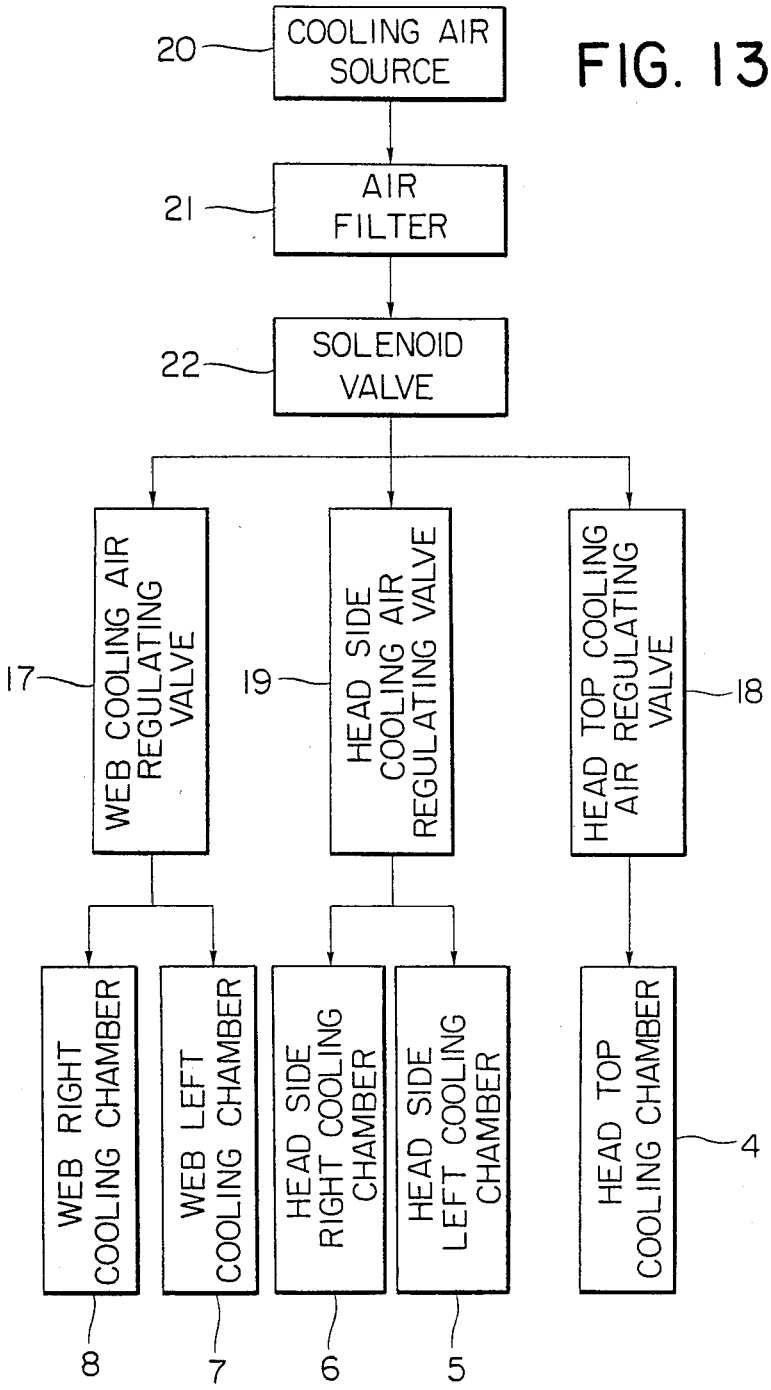
FIG. 13 is a block diagram illustrating an outline of the cooling air supply mechanism which is one of the components of the apparatus of said another embodiment of the present invention shown in FIG. 9.

The head top cooling chamber 4 has a plurality of cooling air nozzles 13 directed toward the rail head top 1*a* of the butt-welded portion of the rail 1. The head side left cooling chamber 5 has a plurality of cooling air nozzles 13 directed toward a rail head side 1*b* of the butt-welded portion. The head side right cooling chamber 6 has a plurality of cooling air nozzles 13 directed toward the other rail head side 1*b'* of the butt-welded portion. The head cooling air regulating valve 16 mentioned above with reference to FIGS. 2 to 5 for regulating the flow rate of cooling air to be supplied to the head cooling chamber 3 comprises, as shown in FIG. 13, a head top cooling air regulating valve 18 for regulating the flow rate of cooling air to be supplied to the head top cooling chamber 4, and a head side cooling air regulating valve 19 for regulating the flow rate of cooling air to be supplied to the head side left cooling chamber 5 and the head side right cooling chamber 6. A thermometer 15 for continuously measuring the surface temperature of the rail head top 1*a* of the butt-welded portion is provided in the head top cooling chamber 4 as shown in FIGS. 11 and 12.

Figure 14:
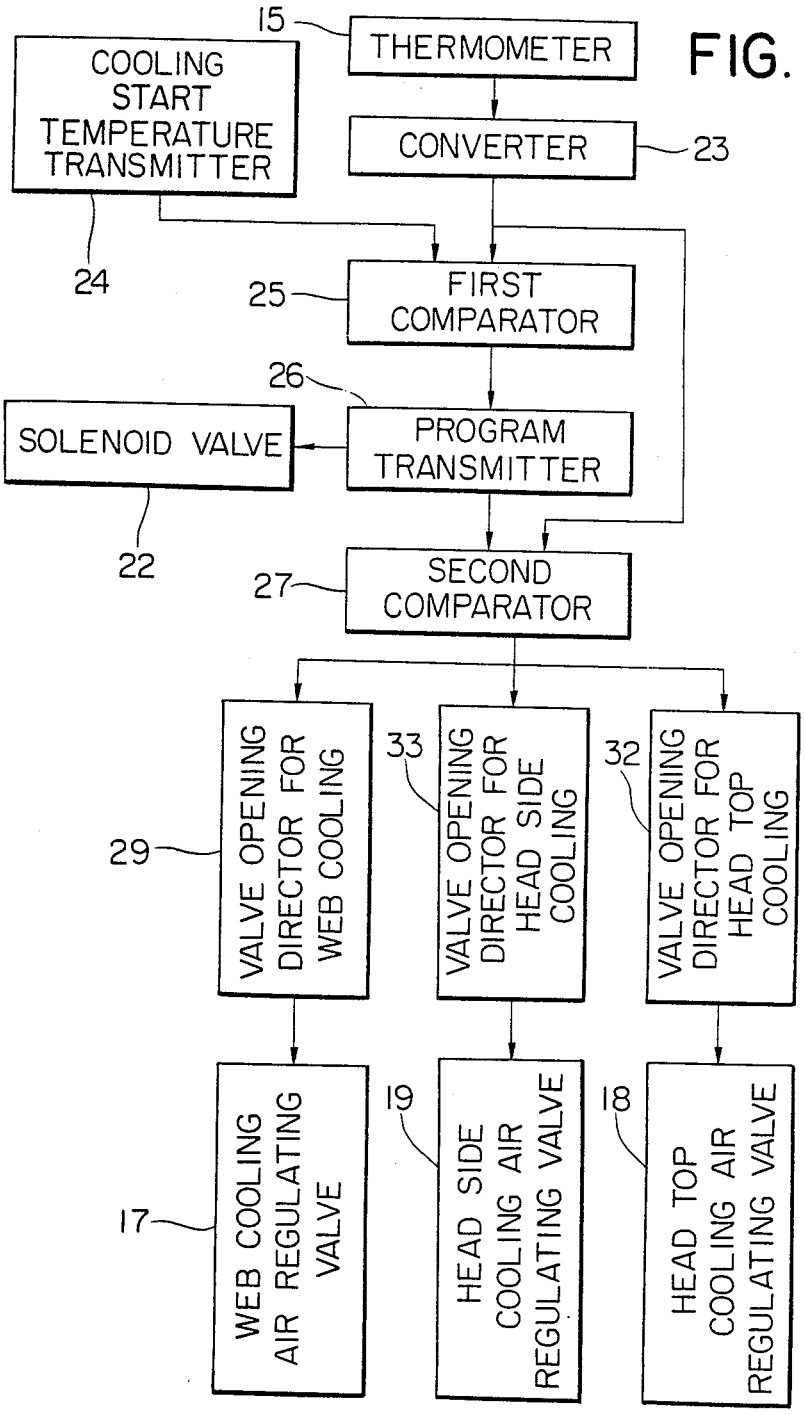
FIG. 14 is a block diagram illustrating a first embodiment of the valve opening controlling means of the cooling air supply mechanism, which valve opening controlling means is one of the components of the apparatus of said another embodiment of the present invention shown in FIG. 9.

The valve opening director for head cooling 28 in the first embodiment of the valve opening controlling means of the cooling air supply mechanism comprises, as shown in FIG. 14, a valve opening director for head top cooling 32 and a valve opening director for head side cooling 33. The valve opening director for head top cooling 32 amplifies the difference calculated by the second comparator 27 between an electric signal from the converter 23 which corresponds to a measured surface temperature of the rail head top 1*a* of the butt-welded portion, and an electric signal from the program transmitter 26 which corresponds to a previously set time-serial target surface temperature, and transmits to the head top cooling air regulating valve 18 an opening of the head top cooling air regulating valve 18 in the form of an electric signal, in which the thus amplified value of difference becomes null. The valve opening director for head side cooling 33 amplifies the above-mentioned difference value calculated by the second comparator 27, and transmits to the head side cooling air regulating valve 19 an opening of the head side cooling air regulating valve 19 in the form of an electric signal, in which the thus amplified value of difference becomes null.

Figure 15:
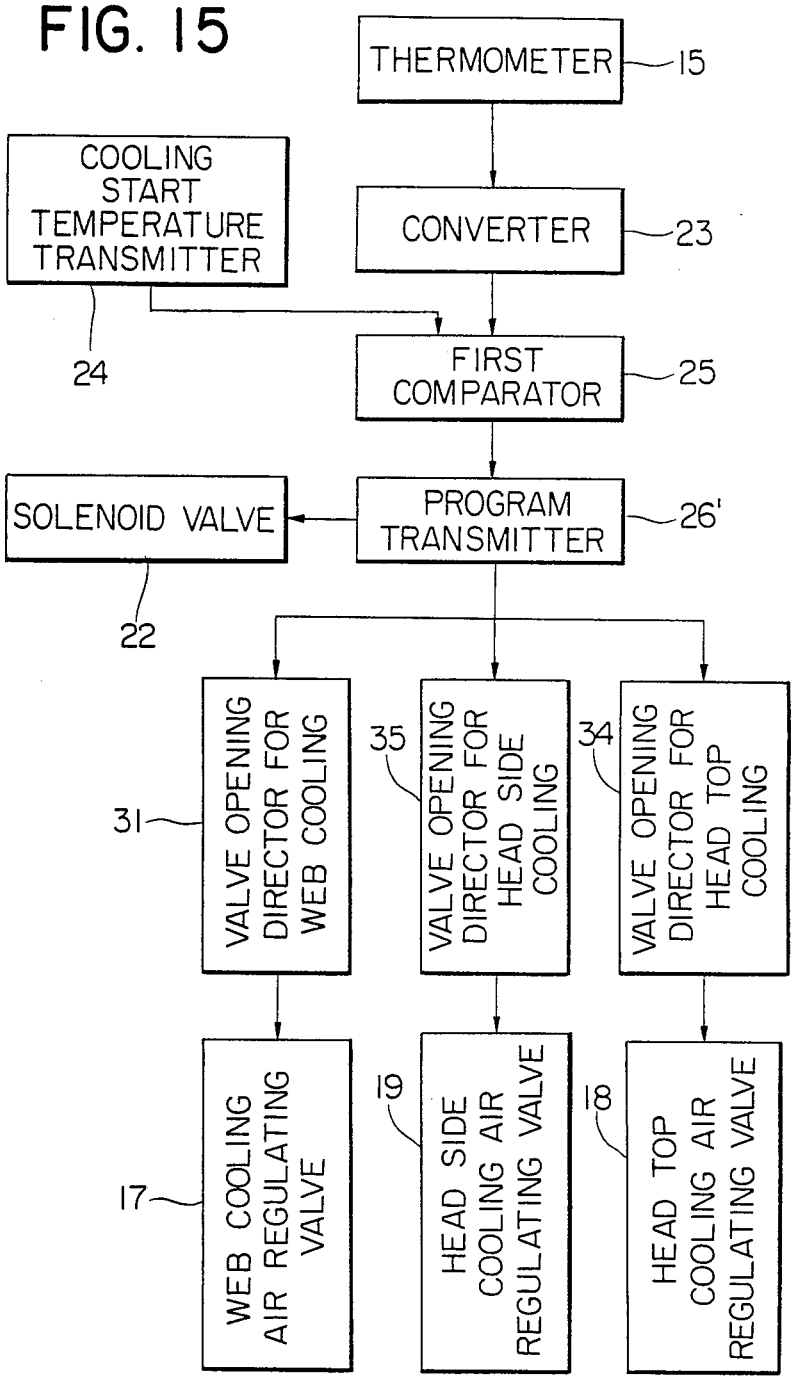
FIG. 15 is a block diagram illustrating a second embodiment of the valve opening controlling means of the cooling air supply mechanism, which valve opening controlling means is one of the components of the apparatus of said another embodiment of the present invention shown in FIG. 9.

The valve opening director for head cooling 30 in the second embodiment of the valve opening controlling means of the cooling air supply mechanism comprises, as shown in FIG. 15, a valve opening director for head top cooling 34, and a valve opening director for head side cooling 35. The valve opening director for head top cooling 34 amplifies an electric signal from the program transmitter 26', which corresponds to a previously set time-serial target flow rate of cooling air, and transmits to the head top cooling air regulating valve 18 an opening of the head top cooling air regulating valve 18 in the form of an electric signal, in response to the thus amplified electric signal. The valve opening director for head side cooling 35 amplifies an electric signal from the program transmitter 26', which corresponds to the above-mentioned time-serial target flow rate of cooling air, and transmits to the head side cooling air regulating valve 19 an opening of the head side cooling air regulating valve 19 in the form of an electric signal, in response to the thus amplified electric signal.

The construction of the quenching apparatus in this embodiment is the same as that of the quenching apparatus shown in FIGS. 2 to 8, except for the points described above. As has been described above with reference to FIGS. 2 to 8, as a result of opening of the solenoid valve 22 in response to the electric signal from the program transmitter 26 or 26', cooling air is supplied from the cooling air source 20, as shown in FIG. 13, through the head top cooling air regulating valve 18 to the head top cooling chamber 4, and through the head side cooling air regulating valve 19 to each of the head side left cooling chamber 5 and the head side right cooling chamber 6, and through the web cooling air regulating valve 17 to each of the web left cooling chamber 7 and the web right cooling chamber 8.

Cooling air supplied to the head top cooling chamber 4 is ejected through the plurality of cooling air nozzles 13 provided in the head top cooling chamber 4 onto the rail head top 1*a* of the butt-welded portion, to quench the rail head top 1*a*. Cooling air supplied to the head side left cooling chamber 5 and the head side right cooling chamber 6 is ejected through the plurality of cooling air nozzles 13 provided in each of the head side left cooling chamber 5 and the head side right cooling chamber 6 onto the rail head sides 1*b* and 1*b'* of the butt-welded portion, to quench the rail sides 1*b* and 1*b'*. Cooling air supplied to the web left cooling chamber 7 and the web right cooling chamber 8 is ejected through the plurality of cooling air nozzles 13 provided in each of the web left cooling chamber 7 and the web right cooling chamber 8 onto the rail web sides 1*c* and 1*c'* and the rail bottom surfaces 1*d* and 1*d'* of the butt-welded portion, to quench the rail web sides 1*c* and 1*c'* and the rail bottom surfaces 1*d* and 1*d'*.

In the case of the first embodiment of the valve opening controlling means of the cooling air supply mechanism shown in FIG. 14, each opening of the head top cooling air regulating valve 18, the head side cooling air regulating valve 19 and the web cooling air regulating valve 17 is controlled as follows. The program transmitter 26 transmits to the second comparator 27, the previously set time-serial target surface temperature for the rail head top 1*a* of the butt-welded portion in the form of an electric signal during the cooling period from cooling start up to cooling completion, in response to the cooling start electric signal from the first comparator 25. The second comparator 27 continuously calculates the difference between the electric signal from the converter 23 which corresponds to the measured surface temperature of the rail head top of the butt-welded portion, and the electric signal from the program transmitter 26 which corresponds to the above-mentioned time-serial target surface temperature and transmits the thus calculated difference value to the valve opening director for head top cooling 32, the valve opening director for head side cooling 33 and the valve opening director for web cooling 29.

The valve opening director for head top cooling 32 amplifies the above-mentioned difference value calculated by the second comparator 27, and transmits to the head top cooling air regulating valve 18 an opening of the head top cooling air regulating valve 18 in the form of an electric signal, in which the thus amplified difference value becomes null. The opening of the head top cooling air regulating valve 18 is thus adjusted in response to the above-mentioned electric signal from the valve opening director for head top cooling 32. The valve opening director for head side cooling 33 amplifies the above-mentioned difference value calculated by the second comparator 27, and transmits to the head side cooling air regulating valve 19 an opening of the head side cooling air regulating valve 19 in the form of an electric signal, in which the thus amplified difference value becomes null. The opening of the head side cooling air regulating valve 19 is thus adjusted in response to the above-mentioned electric signal from the valve opening director for head side cooling 33. The valve opening director for web cooling 29 amplifies the above-mentioned difference value calculated by the second comparator 27, and transmits to the web cooling air regulating valve 17 an opening of the web cooling air regulating valve 17 in the form of an electric signal, in which the thus amplified difference becomes null. The opening of the web cooling air regulating valve 17 is thus adjusted in response to the above-mentioned electric signal from the valve opening director for web cooling 29.

In the case of the second embodiment of the valve opening controlling means of the cooling air supply mechanism shown in FIG. 15, each opening of the head top cooling air regulating valve 18, the head side cooling air regulating valve 19 and the web cooling air regulating valve 17 is controlled as follows. The program transmitter 26' transmits, to the valve opening director for head top cooling 34, the valve opening director for head side cooling 35 and the valve opening director for web cooling 31, the previously set time-serial target flow rate of cooling air in the form of an electric signal during the cooling period from cooling start up to cooling completion, in response to the cooling start electric signal from the first comparator 25.

The valve opening director for head top cooling 34 amplifies the electric signal from the program transmitter 26', which corresponds to the above-mentioned time-serial target flow rate of cooling air, and transmits to the head top cooling air regulating valve 18 an opening of the head top cooling air regulating valve 18 in the form of an electric signal, in response to the thus amplified electric signal. The opening of the head top cooling air regulating valve 18 is thus adjusted in response to the above-mentioned electric signal from the valve opening director for head top cooling 34. The valve opening director for head side cooling 35 amplifies the electric signal from the program transmitter 26', which corresponds to the above-mentioned time-serial target flow rate of cooling air, and transmits to the head side cooling air regulating valve 19 an opening of the head side cooling air regulating valve 19 in the form of an electric signal, in response to the thus amplified electric signal. The opening of the head side cooling air regulating valve 19 is thus adjusted in response to the above-mentioned electric signal from the valve opening director for head side cooling 35. The valve opening director for web cooling 31 amplifies the electric signal from the program transmitter 26', which corresponds to the above-mentioned time-serial target flow rate of cooling air, and transmits to the web cooling air regulating valve 17 an opening of the web cooling air regulating valve 17 in the form of an electric signal, in response to the thus amplified electric signal. The opening of the web cooling air regulating valve 17 is thus adjusted in response to the above-mentioned electric signal from the valve opening director for web cooling 31.

Thus, the rail head top 1*a*, the rail head sides 1*b* and 1*b'*, the rail web sides 1*c* and 1*c'* and the rail bottom surfaces 1*d* and 1*d'* of the butt-welded portion are quenched to a prescribed temperature by means of cooling air ejected from the plurality of cooling air nozzles 13 provided in each of the head top cooling chamber 4, the head side left cooling chamber 5, the head side right cooling chamber 6, the web left cooling chamber 7 and the web right cooling chamber 8.

Figure 16:
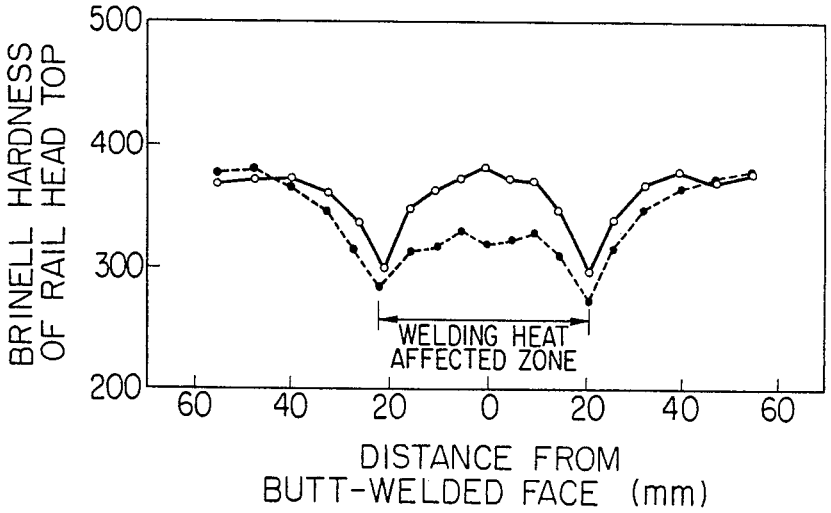
FIG. 16 is a graph illustrating Brinell hardness of the rail head top in the butt-welded portion of a rail as quenched by the use of the apparatus of said another embodiment of the present invention shown in FIGS. 9 to 13, having the valve opening controlling means in the second embodiment shown in FIG. 15, of the cooling air supply mechanism.

FIG. 16 is a graph illustrating Brinell hardness of the rail head top in the butt-welded portion of a rail as quenched by the use of the apparatus of the embodiment of the present invention shown in FIGS. 9 to 13, having the valve opening controlling means in the second embodiment shown in FIG. 15, of the cooling air supply mechanism. In FIG. 16, plots of white circles represent Brinell hardness of the rail head top 1*a* of the butt-welded portion of the rail 1 as quenched by the use of the above-mentioned apparatus of the present invention, and plots of black circles, Brinell hardness of the rail head top 1*a* of the butt-welded portion of the rail 1 not quenched. As is clear from FIG. 16, when quenching the butt-welded portion of the rail 1 by the use of the above-mentioned apparatus of the present invention, decrease in Brinell hardness of the rail head top 1*a* in the welding heat affected zone within the distance of about 20 mm from the butt-welded face is minimized, and as compared with the case without quenching of the butt-welded portion, Brinell hardness of the rail head top 1*a* in the above-mentioned welding heat affected zone is remarkably improved.

As described above in detail, by quenching the butt-welded portion of the rail immediately after butt-welding, with the use of the apparatus of the present invention, it is possible to prevent a decrease in hardness of the rail head in the butt-welded portion affected by welding heat from occurring, and as a result, the rail head top of the butt-welded portion is not subjected to earlier wear, deformation and cave-in than other rail portions even after many passages of trains, thus providing many industrially useful effects.

What is claimed is:

1. An apparatus for quenching a butt-welded portion of a rail, comprising:

an inverse U-shaped cooling box (2) for covering from above and throughout a butt-welded portion of a rail (1), and for quenching said butt-welded portion by ejection of cooling air, said cooling box (2) including two partition plates (9, 10) for dividing said cooling box into a head cooling chamber (3), a web left cooling chamber (7) and a web right cooling chamber (8), which chambers are independent of each other, each of said head cooling chamber, said web left cooling chamber and said web right cooling chamber having a plurality of cooling air nozzles (13) arranged to be directed toward said butt-welded portion;

a cooling air supply mechanism for supplying cooling air to said cooling box (2), said cooling air supply mechanism comprising a cooling air source (20), a solenoid valve (22) for selectively opening and closing the flow of cooling air, a cooling air supply pipe arranged with said solenoid valve for introducing cooling air from said cooling air source (20) into each of said head cooling chamber (3), said web left cooling chamber (7) and said web right cooling chamber (8), a head cooling air regulating valve (16) for regulating a flow rate of cooling air to be supplied to said head cooling chamber (3), a web cooling air regulating valve (17) for regulating a flow rate of cooling air to be supplied to said web left cooling chamber (7) and said web right cooling chamber (8), and valve opening controlling means for controlling an opening of each of said head cooling air regulating valve (16) and said web cooling air regulating valve (17); and a cooling box holding mechanism (36) for releasably holding said cooling box (2) at a prescribed position so as to cover said rail (1) throughout said butt-welded portion, said holding mechanism comprising a horizontal supporting plate (37) fixed to a side of said cooling box which extends at right angles to the axial line of said rail, a pair of clamps (38, 39) located on the lower surface of said supporting plate for gripping the head of said rail to hold releasably said cooling box (2) at a prescribed position so as to cover said rail throughout said butt-welded portion, one clamp (38) of said pair of clamps being slidable at right angles to the axial direction of said rail along the lower surface of said supporting plate, and the other clamp (39) being fixed to the lower surface of said supporting plate, a horizontally arranged rod (40) fixed at one end to said slidable clamp (38) and projecting at right angles to the axial direction of said rail (1), and a lever (42) and a link (41) for coupling said lever to the other end of said rod, a top end of said lever being pivotally connected to the lower surface of said supporting plate so that said slidable clamp is guided by said rod and urged by said link to grip the head of said rail in clamping relation with said other clamp when said lever is operated, wherein said cooling box is held at said prescribed position so as to cover throughout said butt-welded portion of said rail.

2. The apparatus as claimed in claim 1, characterized in that:

said valve opening controlling means of said cooling air supply mechanism comprises:

a thermometer (15) for continuously measuring the surface temperature of a head top (1*a*) of said butt-welded portion of said rail (1);

a converter (23) for converting the surface temperature of said head top (1*a*) of said butt-welded portion, continuously measured by said thermometer (15), into an electric signal;

a cooling start temperature transmitter (24) for transmitting a predetermined cooling start temperature for said head top (1*a*) of said butt-welded portion in the form of an electric signal;

a first comparator (25) for transmitting a cooling start electric signal when said electric signal from said converter (23), which corresponds to said measured surface temperature of said head top (1*a*) of said butt-welded portion, agrees with said electric signal from said cooling start temperature transmitter (24), which corresponds to said cooling start temperature;

a program transmitter (26) for transmitting a time-serial target surface temperature of said head top (1*a*) of said butt-welded portion, during a cooling period from start of cooling to completion of cooling, in the form of an electric signal, said program transmitter (26) transmitting an electric signal for opening said solenoid valve (22) in response to said cooling start electric signal from said first comparator (25), an electric signal corresponding to said time-serial target surface temperature, and an electric signal for closing said solenoid valve (22) at the moment of completion of said cooling period;

a second comparator (27) for continuously calculating a difference value between said electric signal from said converter (23), which corresponds to said surface temperature of said head top (1*a*) of said butt-welded portion, and said electric signal from said program transmitter (26), which corresponds to said time-serial target surface temperature;

a valve opening director for head cooling (28) for amplifying said value of difference calculated by said second comparator (27) and transmitting, toward said head cooling air regulating valve (16), an opening of said head cooling air regulating valve (16) in the form of an electric signal, in which said amplified value of difference becomes null; and a valve opening director for web cooling (29) for amplifying said value of difference calculated by said second comparator (27) and transmitting, toward said web cooling air regulating valve (17), an opening of said web cooling air regulating valve (17) in the form of an electric signal, in which said amplified value of difference becomes null.

3. The apparatus as claimed in claim 1, characterized in that:

said valve opening controlling means of said cooling air supply mechanism comprises:

a thermometer (15) for continuously measuring the surface temperature of a head top (1*a*) of said butt-welded portion of said rail (1);

a converter (23) for converting the surface temperature of said head top (1*a*) of said butt-welded portion, continuously measured by said thermometer (15), into an electric signal;

a cooling start temperature transmitter (24) for transmitting a cooling start temperature for said head top (1*a*) of said butt-welded portion in the form of an electric signal;

a first comparator (25) for transmitting a cooling start electric signal when said electric signal from said converter (23), which corresponds to said measured surface temperature of said head top (1*a*) of said butt-welded portion, agrees with said electric signal from said cooling start temperature transmitter (24), which corresponds to said cooling start temperature;

a program transmitter (26′) for transmitting a time-serial target flow rate of cooling air, during a cooling period from start of cooling to completion of cooling, in the form of an electric signal, said program transmitter (26′) transmitting an electric signal for opening said solenoid value (22) in response to said cooling start electric signal from said first comparator (25), an electric signal corresponding to said time-serial target flow rate of cooling air, and an electric signal for closing said solenoid valve (22) at the moment of completion of said cooling period;

a valve opening director for head cooling (30) for amplifying said electric signal from said program transmitter (26′), which corresponds to said time-serial target flow rate of cooling air, and transmitting, toward said head cooling air regulating valve (16), an opening of said head cooling air regulating valve (16) in the form of an electric signal, in response to said amplified electric signal from said program transmitter (26'); and a valve opening director for web cooling (31) for amplifying said electric signal from said program transmitter (26'), which corresponds to said time-serial target flow rate of cooling air, and transmitting, toward said web cooling air regulating valve (17), an opening of said web cooling air regulating valve (17) in the form of an electric signal, in response to said amplified electric signal from said program transmitter (26').

4. The apparatus as claimed in claim 1, characterized in that:

said head cooling chamber (3) of said cooling box (2) is divided by two partition plates (11, 12) into a head top cooling chamber (4), a head side left cooling chamber (5) and a head side right cooling chamber (6), which are independent of each other, each of said head top cooling chamber, said head side left cooling chamber and said head side right cooling chamber having a plurality of cooling air nozzles (13) directed toward said butt-welded portion of said rail (1); and said head cooling air regulating valve (16) of said cooling air supply mechanism comprises a head top cooling air regulating valve (18) for regulating a flow rate of cooling air to be supplied to said head top cooling chamber (4), and a head side cooling air regulating valve (19) for regulating a flow rate of cooling air to be supplied to said head side left cooling chamber (5) and said head side right cooling chamber (6).

5. The apparatus as claimed in claim 2, characterized in that:

said head cooling chamber (3) of said cooling box (2) is divided by two partition plates (11, 12) into a head top cooling chamber (4), a head side left cooling chamber (5) and a head side right cooling chamber (6), which are independent of each other, each of said head top cooling chamber, said head side left cooling chamber and said head side right cooling chamber having a plurality of cooling air nozzles (13) directed toward said butt-welded portion of said rail (1); and said head cooling air regulating valve (16) of said cooling air supply mechanism comprises a head top cooling air regulating valve (18) for regulating a flow rate of cooling air to be supplied to said head top cooling chamber (4), and a head side cooling air regulating valve (19) for regulating a flow rate of cooling air to be supplied to said head side left cooling chamber (5) and said head side right cooling chamber (6).

6. The apparatus as claimed in claim 3, characterized in that:

said head cooling chamber (3) of said cooling box (2) is divided by two partition plates (11, 12) into a head top cooling chamber (4), a head side left cooling chamber (5) and a head side right cooling chamber (6), which are independent of each other, each of said head top cooling chamber, said head side left cooling chamber and said head side right cooling chamber having a plurality of cooling air nozzles (13) directed toward said butt-welded portion of said rail (1); and said head cooling air regulating valve (16) of said cooling air supply mechanism comprises a head top cooling air regulating valve (18) for regulating a flow rate of cooling air to be supplied to sid head top cooling chamber (4), and a head side cooling air regulating valve (19) for regulating a flow rate of cooling air to be supplied to said head side left cooling chamber (5) and said head side right cooling chamber (6).

7. The apparatus as claimed in claim 5, characterized in that:

said valve opening director for head cooling (28) of said valve opening controlling means of said cooling air supply mechanism comprises:

a valve opening director for head top cooling (32) for amplifying said value of difference calculated by said second comparator (27) and transmitting, toward said head top cooling air regulating valve (18), an opening of said head top cooling air regulating valve (18) in the form of an electric signal, in which said amplified value of difference becomes null; and a valve opening director for head side cooling (33) for amplifying said value of difference calculated by said second comparator (27) and transmitting, toward said head side cooling air regulating valve (19), an opening of said head side cooling air regulating valve (19) in the form of an electric signal, in which said amplified value of difference becomes null.

8. The apparatus as claimed in claim 6, characterized in that:

said valve opening director for head cooling (30) of said valve opening controlling means of said cooling air supply mechanism comprises:

a valve opening director for head top cooling (34) for amplifying said electric signal from said program transmitter (26'), which corresponds to said time-serial target flow rate of cooling air, and transmitting, toward said head top cooling air regulating valve (18), an opening of said head top cooling air regulating valve (18) in the form of an electric signal, in response to said amplified electric signal from said program transmitter (26'); and a valve opening director for head side cooling (35) for amplifying said electric signal from said program transmitter (26'), which corresponds to said time-serial target flow rate of cooling air, and transmitting, toward said head side cooling air regulating valve (19), an opening of said head side cooling air regulating valve (19) in the form of an electric signal, in response to said amplified electric signal from said program transmitter (26').

* * * * *